United States Patent [19]

Huber et al.

[11] 4,319,855

[45] Mar. 16, 1982

[54] HIGHWAY EXPANSION JOINT

[75] Inventors: Reinhold Huber, Rorbas, Switzerland; Waldemar Köster, Forsbach, Fed. Rep. of Germany

[73] Assignee: Kober AG, Glarus, Switzerland

[21] Appl. No.: 25,268

[22] Filed: Mar. 29, 1979

[30] Foreign Application Priority Data

Sep. 28, 1978 [DE] Fed. Rep. of Germany ..... 2842171

[51] Int. Cl.[3] ..... E01C 11/04

[52] U.S. Cl. ..... 404/68; 52/396; 14/16.5

[58] Field of Search ..... 404/68, 67, 66, 64, 404/49, 47; 14/16.5; 52/396, 403

[56] References Cited

U.S. PATENT DOCUMENTS

| | | | |
|---|---|---|---|
| 1,977,496 | 10/1934 | Snyder | 404/47 X |
| 2,315,588 | 4/1943 | Brickman | 404/67 |
| 3,245,328 | 4/1966 | Fassbinder | 404/47 |
| 3,316,574 | 5/1967 | Pare | 404/47 X |
| 3,422,733 | 1/1969 | Connell | 404/49 X |
| 3,555,982 | 1/1971 | George | 404/69 |
| 3,767,311 | 10/1973 | Pare | 404/67 |
| 3,797,188 | 3/1974 | Mansfeld | 404/47 X |
| 3,826,583 | 7/1974 | Pare | 404/67 |
| 3,899,261 | 8/1975 | Mieville | 404/68 |

FOREIGN PATENT DOCUMENTS

| | | |
|---|---|---|
| 986763 | 4/1976 | Canada . |
| 1001876 | 12/1976 | Canada . |
| 1658468 | 9/1970 | Fed. Rep. of Germany . |
| 1534262 | 11/1971 | Fed. Rep. of Germany . |
| 2314967 | 10/1973 | Fed. Rep. of Germany . |
| 2235413 | 2/1976 | Fed. Rep. of Germany . |
| 2258770 | 6/1978 | Fed. Rep. of Germany . |
| 2228599 | 8/1978 | Fed. Rep. of Germany . |
| 87647 | 9/1966 | France . |
| 1051957 | 12/1966 | United Kingdom . |

*Primary Examiner*—Nile C. Byers, Jr.

[57] ABSTRACT

An elongated plate of elastomeric material is provided with anchoring means along its side edges for fixedly connecting the same to the sections of the road bed on opposite sides of the gap. Spring means are embedded within the plate transverse to the longitudinal axis and secured at its ends to the respective anchoring means so as to be expanded and/or contracted corresponding to the movement of the road section. The spring means preferably comprise helically wound coils spaced in parallel to each other, transverse to the longitudinal direction of the plate.

25 Claims, 17 Drawing Figures

HIGHWAY EXPANSION JOINT

BACKGROUND OF THE INVENTION

The present invention relates to a road or highway expansion joint and in particular to elastic cover strips for sealing the gap between abutting road sections.

Cover strips used for closing the expansion joint of highway or road bed sections are generally known. One such strip (German Pat. No. 25 35 413) is formed of an elastomeric plate having on its underside a pair of open recesses which extend parallel to the center line of the joint and have strengthening ribs running transversely thereto. Reinforcing inserts may also be provided within the strengthening ribs. The ribs serve to distribute the tensional stresses on the one hand and to counteract the upward bulging of the plate in response to the movement of the pavement under compression. By arranging the two spaced recesses, next to each other, so that one overlies the gap between adjacent road sections, the plate area located therebetween is pushed against one section of the concrete base when the cover is placed under compression. However, due to the great forces acting to deform the plate, the ribs are insufficient to assure a continual flat running surface over that portion covering the gap.

In another known arrangement (German Offenlegungschrift No. 1,940,000) an elastomeric plate is anchored to the road bed sections along both its longitudinal side edges under a preloaded transverse tensional force. Aging of the material is accelerated on account of the high material stresses placed on the plate during use. Thus, in the course of time, the elastomeric material creeps apart from the direction of the tensile forces so that the preloaded stress weakens, resulting in the contraction of the elastomeric materials, the plate is then stressed in compression and arches upwardly in the process.

Also known is a cover strip having deep depressions on its top and the bottom surfaces (see German Pat. No. 1,534,377.) When viewed in plan, the depressions have a bow-shape extending transverse to the longitudinal direction of the expansion joint. Despite this, the danger of their buckling out of the plane of the roadbed surface cannot be prevented. This known cover strip, like those described earlier, is formed of rubber without reinforcing inserts and is thus capable of absorbing only relatively small vertical loads.

Another known cover strip having considerably load carrying capacity is shown in U.S. Pat. No. 3,316,574 and German Auslegeschrift No. 2,228,599. These strips utilize plate shaped inserts embedded within the rubber body to bridge the gap between abutting road bed sections. The expansion of the joint is absorbed by the cavities in the rubber body which runs longitudinally laterally adjacent to the gap itself. Since the bridging area of the strip, and the plate-shaped inserts do not function to compensate for material shift caused by the relative movement of the joint, these plate-shaped inserts must be of considerable width in order to be effective.

These disadvantages are overcome by forming a cover strip for road bed expansion joints which retains great elasticity under expansion as well as contraction and has a high load carrying capacity while retaining a stable position avoiding any buckling upward in all states of compression or tension.

SUMMARY OF THE INVENTION

According to the present invention, a cover strip for use in forming expansion joints for roadbeds and the like is provided comprising an elongated plate of elastomeric material having anchoring means along its side edges for fixedly connecting the same to the sections of the road bed on opposite sides of the gap. Spring means are embedded within the plate transverse to the longitudinal axis and secured at its ends to the respective anchoring means so as to be expanded and/or contracted corresponding to the movement of the road bed section.

The spring means preferably comprise helically wound coils spaced parallel to each other, transverse to the longitudinal direction of the plate. The spring means, i.e. the helical coils, act in the sense of a reinforcing insert, increasing the load carrying capacity of the cover strip, while at the same time, having an elasticity and flexibility fully responsive to the movement of the expansion joint. As a result, relatively narrow plate widths will suffice in forming cover strips for the expansion joint.

The spring means, e.g. helical coils, are preferably cast or vulcanized in situ into the elastomeric material to form therewith an adhesive bonding. The elastomeric material preferably consists of a synthetic and/or natural rubber, although other elastomeric synthetic materials may be used. The spring means, e.g. helical coils, on the other hand consist of a hard, but elastic material, such as metal or plastic. A suitable preselection of the shape of the helical turns and the pitch between the turns makes it possible to provide an elasticity and load carrying capacity conforming to selected and/or predetermined roadbed and climatic conditions. Of importance to the load carrying capacity of the strip is the connection of the ends of the spring means, e.g. the helical coils, to the adjacent anchoring means of the strip so that a tension proof, i.e. non-separable connection is obtained, causing the spring means to expand or compress relative to the roadbed section conjointly with but not relative to the anchoring means.

The spring means are preferably disposed below the central horizontal plane of the plate, i.e. closer to the lower bearing surface. As a result, the force of the spring means has a low center which causes the plane of the elastomeric strip to be pushed down when stressed in compression, thus preventing buckling. An increase in load carrying capacity may be obtained by disposing a plurality of the spring means in two or more layers on top of each other. The upper layers need not extend completely across the elastomeric strip, but it is sufficient that they be anchored at one end of the anchoring means and extend in horizontal plane generally parallel to the lower spring means inwardly. The spring means of the upper layer may be staggered relative to those of the lower layers.

The turns of spring means, e.g. helical coils, can take various shapes and the pitch between the turns may be selectively varied. Circular turns, oval turns, eggshaped turns may be employed singly or in periodic combination in a given spring, and sections of a given spring may be divided by their pitch.

In one form of the present invention, the volume of the elastomeric strip enveloped by the spring means, e.g. helical coil, is retained hollow providing a hollow bore for the spring so that upon deformation the material of the elastomeric strip can be displaced into the hollow space without a deformation of the outer contour of the strip. If desired, a central core or rod may be inserted into the hollow space without deformation of the outer contour of the strip. If desired, a central core or rod may be inserted into the hollow space within the coil. Further, sections of the elastomeric strip may be removed leaving a recess, which permits increased flexibility and resiliency without loss of strength or stiffness against deformation in use. The elastomeric strip can be stiffened and reinforced by the use of various means located between or adjacent to the spring means and/or the recesses, such reinforcements will increase the load carrying capacity without disturbing the ability of the strip to expand and to contract. The reinforcement means may take the form of metallic or plastic plates, rods, or articulated pleated sections.

Full details of the present invention are set forth in the following description, and are shown in the accompanying drawings.

DESCRIPTION OF THE INVENTION

Figure 1:
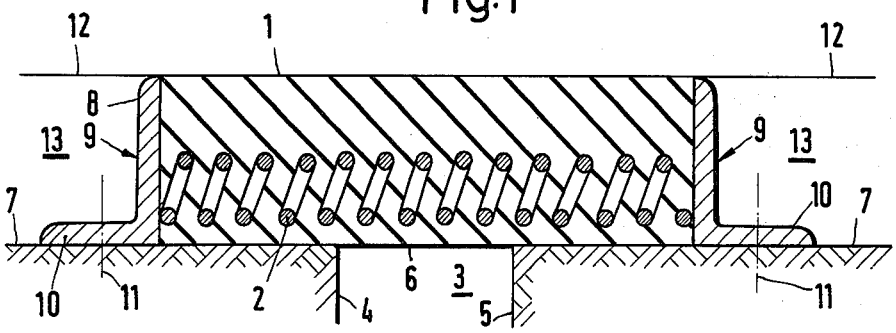
FIG. 1 is a transverse sectional view through abutting sections of a road bed showing the expansion joint assembly of the present invention.
Figure 2:
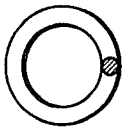
FIG. 2 is an end view of spring means employed in the assembly of FIG. 1.
Figure 3:
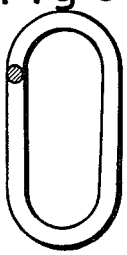
FIG. 3 is a view similar to that of FIG. 2, showing a second form of spring means.
Figure 4:
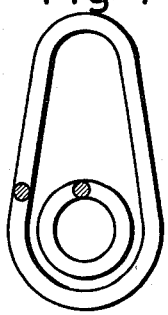
FIG. 4 is a view similar to that of FIG. 2, showing the employment of two different shaped spring means simultaneously.

Turning to FIG. 1, an expansion joint assembly formed in accordance with the present invention is illustrated in cross-section. The assembly comprises a cover, comprising an elongated plate-like strip 1 lying across a gap 3, formed at the joint between two sections 4 and 5 of a road or highway bed so as to seal the gap from entry of water or moisture. The strip 1 is formed of an elongated block of elastomeric material such as rubber in which is embedded at least one wire springs. The springs are inserted during formation of the strip and prior to vulcanization or other completion of the setting of the elastomeric material so as to be intimately bonded therewith. The strip 1 has a transverse width sufficient so that its undersurface 6 overlaps the edges of the gap 3 and rests on the horizontal surface 7 of the road substructure generally formed of a concrete base. The opposite longitudinal edges of the strip 1 are supported by the vertical legs 8 of an elongated right angle bracket 9. The height of the leg 8 substantially conforms to the depth of the strip 1. The horizontal legs 10 of brackets 9 are anchored by screws, bolts, or the like 11 to the concrete base substructure. The vertical legs 8 of the right angle brackets 9 are similarly vulcanized together with the springs 2 to the elastomeric material so as to be intimately and permanently bonded therewith. In addition, the opposite ends of the springs 2 are secured as by screws, welding, or the like, to the respective vertical legs 8 of the angle brackets 9 so that the angle brackets are pulled together to hold the strip 1 under compression but are movable away from each other under a predetermined tension biasing.

Figure 5:
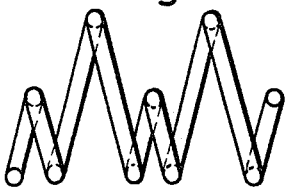
FIG. 5 is a side view of spring means showing two different diametered turns.
Figure 6:
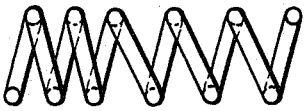
FIG. 6 is a view similar to that of FIG. 5 showing spring means having sections of different pitch.

A plurality of springs 2 are employed and are arranged transversely along the length of the strip 1 in parallel space relationship to each other. Preferably, the springs are helical coil compression springs expandable and contractable along their central axis and may have various shapes and configurations other than that illustrated in FIG. 1, as illustrated in FIGS. 2 through 6. For example, the helical coil may have a circular turn (FIG. 2); an oval turn (FIG. 3); an egg-shaped turn (FIG. 4) in which a second helical coil extends along its lower part. In FIG. 5, the spiral helical coil is formed of alternating large turns while in FIG. 6, a coil having turns of equal diameter are arranged in sections wherein in one section the pitch or distance between adjacent turns are closer to each other than in the other section. Various combinations of the foregoing forms can be used. As will be apparent to those skilled in the present art, any selected or predetermined stress or tension condition in combination with the elastomeric strip may be provided for predetermined road conditions. Equivalent compression members other than helical springs may also be used. It is preferable, however, to place the spring in the lowermost portion (relative to the central horizontal plane) of the elastomeric strip as shown in FIG. 1, so as to prevent an upper buckling of the strip when in use. In the use of combinations of spring means, it is, of course, preferred that the effective central axis of spring force lies below the central horizontal plane of the strip.

In use, the strip 1 is laid lengthwise across the gap 3 so as to cover its entire width. After being placed and secured in position by fastening the bracket legs 10 to the subbase 4 and 5, the normal roadway surface 13 such as concrete or tarmac is laid on the top 7 of the subbase to the level 12, corresponding approximately to the height of the strip 1. Expansion and contraction of the roadway, i.e. subbase 7 and top 13, in the lateral directions of FIG. 1 are thus easily compensated for by conjoint movement of the bracket 9, the spring means 2 and the elastomeric strip 1 which will correspondingly expand and contract. The springs, however, continuously place the strip under resilient compressive load, prevent the material from creeping, provides a reinforced insert against traffic load, and prevents the strip from buckling amongst other advantages.

Figure 7:
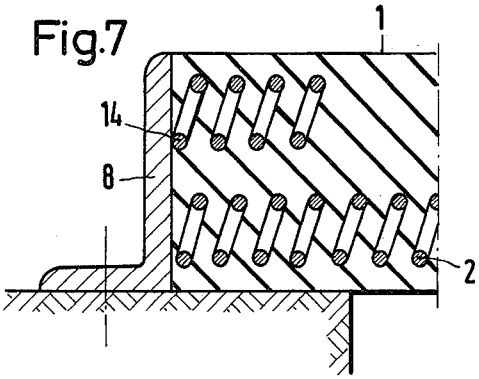
FIG. 7 is an enlarged view of a portion of FIG. 1 showing the employment of two layers of spring means.

To further strengthen the strip, an arrangement such as shown in FIG. 7 may be used. In FIG. 7, one or more additional helical coils of shorter length are arranged above the coil springs 2, which primarily serve to place the strip under compression. The coils 14 are of shorter length and are affixed at only one end to the adjacent vertical leg 8 of one of the brackets 9 and extend only partially inward in horizontal relationship in the strip. Pairs of helical coils 14 can be placed one on each side of the strip inwardly and axially aligned with each other, or they may be offset from each other. The coils 14 may be aligned vertically with the coil springs 2 or offset from them as well. The coils 14 may assume any one or combination of shapes described above with respect to springs 2. An advantage of this construction is that the load carrying capacity of the strip can be increased without reducing resiliency. The number of these auxiliary coils 14 or their pairs may be selected as desired to effect a predetermined load strength.

Figure 8:
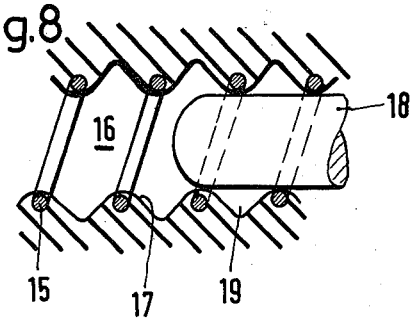
FIG. 8 is an enlarged section of a portion of the assembly showing a hollow interior and a supporting rod located therein.

Another arrangment is illustrated in FIG. 8, which is an enlarged view taken in the same direction of FIG. 1. In the embodiment of FIG. 8, a helical wire coil 15 is embedded within the elastomeric strip concentrically about an interior hollow bore 16. The bore is formed in the shape of an internal thread 17 with the turns of the spiral coil embedded within the thread webs. Arranged within the interior bore is a slidable rod 18 which may be secured at one end to a vertical leg 8 of the respective adjacent bracket member. The rod 18 is thus slidable within the bore conjointly with its attached bracket and serves to increase the load carrying capacity of the strip. The thread grooves 19 formed in the hollow bore may be used as reservoirs for the storage of grease of the like for lubricating the rod 18 during its movement. Alternatively, the rod 18 may be free floating, being unattached.

The particular advantage of this form lies in the fact that the elastomeric material, upon being loaded, can be displaced into the hollow space without the outer contour of the strip being deformed in the process.

The construction of FIG. 8 can be produced simply by setting the spring on a core fitting its inside diameter, placing the spring and core in the mold, and thereafter vulcanizing the strip about it. A particular advantage is obtained when the hollow space has the shape of an internal thread such as a screw shape. A core used for seating the coil having the shape of a screw of appropriate dimensions is then used during the molding and is unscrewed after the material has set. Material displacement under load, can, thus, take place in the area of the thread grooves without constriction of the spring.

The utilization of a slide rod which is movably enveloped by the coil enhances load strength. Such a slide rod if freely movable can be kept centrally over the gap between roadbed sections by guiding means of any kind; however, this can be assured by anchoring it at one end to the bracket 9. Preferably, the rod is dimensioned so that its free end is near the opposite edge of the strip in the narrowest gap position and above the edge of the roadbed section on the other side from its anchor in the widest position. Because the slide rod does not slide on rubber in this embodiment, but along the inside surface of the spring, wear is reduced to a minimum by storing a lubricant supply in the thread grooves of the hollow space. As compared to a known embodiment in which steel rods directly engage holes in the rubber material (German Offenlegungschrift No. 2,314,967), this results in a considerable reduction of wear and of the coefficient of friction of the sliding motion. The slide rods improve the load carrying capacity of such strips and preclude a buckling upwards of the elastomer strip under compression.

The elastomeric strip can be reinforced in the area immediately around the spring by a woven hose enclosing the spiral part in the bore so that any reduction of the material caused by the formation of the hollow bore can be compensated for.

Figure 9:
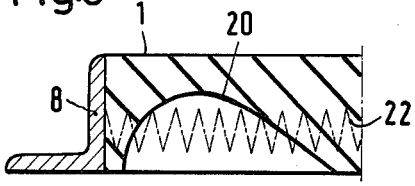
FIG. 9 is a view similar to that of FIG. 1, taken along line IX—IX of FIG. 10 and showing another embodiment of the present invention.
Figure 10:
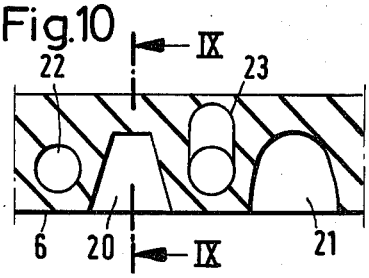
FIG. 10 is a partial longitudinal section of the expansion joint assembly shown in FIG. 9.

Another embodiment is shown in FIGS. 9 and 10. The elastomeric block forming the strip 1 is provided along its length with a plurality of cavities illustrated by cavities 20 and 21 which open towards its lower bearing surface 6. The cavity 20 is trapezoidal while the cavity 21 is arch-shaped in its longitudinal section seen in FIG. 10, while they span only a portion of the transverse width of the strip 1, as seen in FIG. 9. The webs of the elastomeric material remaining between the cavities 20 and 21 serve the purpose of seating the spring means. In the example of FIG. 10, a coil 22 of circular cross-sectional turns, and a coil 23 of alternating round, and oval turns are employed.

Figure 11:
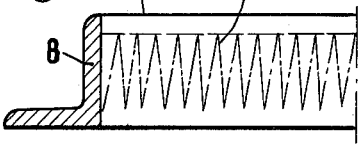
FIG. 11 is a view similar to that of FIG. 9 taken along line XI—XI of FIG. 12.
Figure 12:
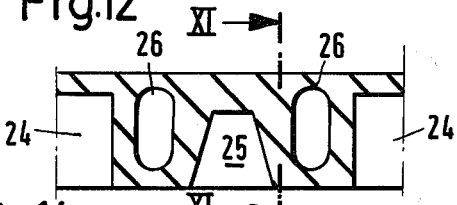
FIG. 12 is a partial longitudinal section of the embodiment shown in FIG. 11.

Various other arrangements may also be formed. For example in FIGS. 11 and 12, rectangular cavities 24 and trapezoidal cavities 25 are provided which span the entire transverse width of the elastomeric strip below the surface. The intermediate webs of elastomeric material embed coils 26 of oval turns.

Figure 13:
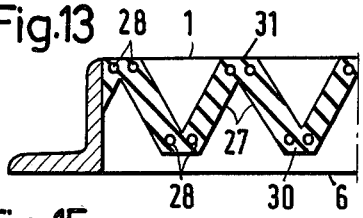
FIG. 13 is a view similar to that of FIG. 9, showing a further embodiment in which pleated reinforcement members are used.
Figure 14:
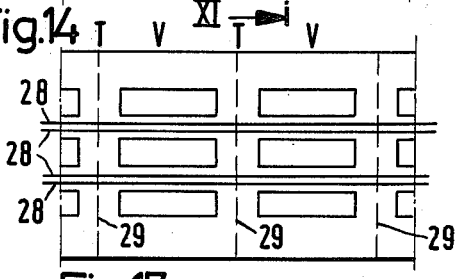
FIG. 14 is a longitudinal plan view of the embodiment shown in FIG. 13.

In FIGS. 13 and 14, the strip 1 is provided along its length with alternate load carrying area T of increased reinforcement and areas V which are more deformable. The deformable areas V are provided with a repeated (i.e. discontinuous) structure embedded in the elastomeric material and formed of a plurality of arms 27 arranged angularly to each other transversely across the strip and secured at the lower ends and the upper ends to elongated longitudinally extending ropes or cables 28 which act to transmit stresses from the deformable area to the reinforced areas. The arms of the pleated structure may be metallic, but are preferably elastomeric material somewhat harder in their resiliency than that of the material forming the strip itself. Preferably, each pleated assembly has arms which are integral at their ends and which are vulcanized at their extreme ends to the vertical legs 8 of the angle bracket 19 and vulcanized or cast integrally into the strip itself. The load carrying areas T may be formed with webs between cavities such as cavities 20 and 21 shown in FIG. 10 or cavities 24 and 25 shown in FIG. 12. The spring means of selected configuration may be embedded within the web to extend transversely to the stip along the line 29.

As seen in FIGS. 13 and 14, a succession of load carrying areas T and deformable areas V extend in plan along the length of the strip. The rope or cable 28 (indicated by solid lines) extends longitudinally along the strip and thus parallel to the axis of the gap. The spring means, such as coils are set in the load carrying areas T indicated by the broken lines 29. As seen in FIG. 13, the upper edge 31 of the pleat arms 27 may be coincident with the surface of the strips while the lower ends 30 may be set above the lower surface of the strip. While this is preferable, other arrangements may be employed.

Figure 15:
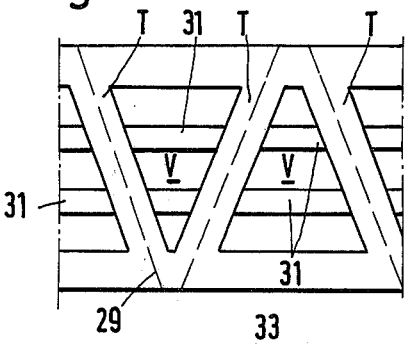
FIG. 15 is a view similar to that of FIG. 14 showing reinforcement areas extending at an angle to the axis of the strip.

A further arrangement is shown in FIG. 15, which is essentially that of the arrangement of FIGS. 13 and 14, except that the load carrying areas T extend alternately obliquely to the axis of the strip with the load carrying areas being formed by elastomeric material webs interspersed between triangularly shaped areas of relatively greater deforming ability. The reinforcing pleats are, furthermore, broadened to run the entire length of the strip as will be seen by the upper pleat portions of FIG. 15. In cross-section, the construction of FIG. 15 looks similar to that of FIG. 13 with the exception of the fact that the pleated members run continuously along the length of the strip.

Figure 17:
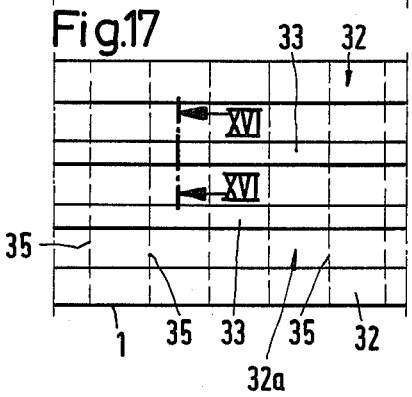
FIG. 17 is a plan view of the embodiment shown in FIG. 16.
Figure 16:
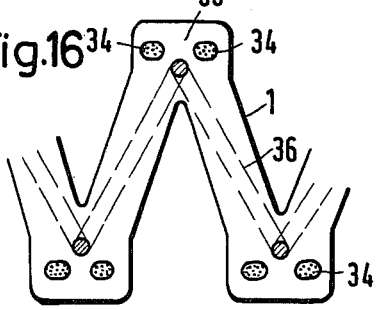
FIG. 16 is a partial transverse section of an assembly formed in the manner of a pleated structure and taken along line XVI—XVI of FIG. 17.

In the embodiment of FIGS. 16 and 17, the elastomeric strip 1 is designed in its totality as a pleated structure. The strip as seen in FIG. 7 comprises alternating solid web sections 32 and pleated sections 32a. The pleated sections comprise a plurality of legs 35 arranged angularly to each other and joined at their apex by connecting members 33 through which ropes or cables 34 extend. The apices 33 are integral with the adjoining solid web sections 32. The helical coil 36 is embedded within the arms 35 having a diameter or pitch lead suitable to the cross-sectional shape of the pleated structure so that the coils are completely embedded therein. The strip member and the coils are integrally vulcanized to each other and to the end brackets as previously described.

Improvement of the ductility and elasticity of the elastomeric strip is obtained by forming these additional hollow spaces outside of the spring which run transverse to the lengthwise direction of the roadbed joint. Obtaining the same advantage while at the same time increasing the load carrying capacity is the sectioning of the strip in longitudinal direction so that areas of high carrying capacity (load carrying areas) alternate with those of great deformability (deforming areas.) The load carrying areas preferably contain the spring means embedded therein. When the deforming areas are designed as pleat structure with the fold direction running transverse to the roadbed joint, and a cable reinforcement extending over the entire length of the strip is cast into the upper and the lower webs of the pleat structure, it is possible to transmit the stress from the weaker areas to the stronger load carrying areas. The cable reinforcement has a further advantage of absorbing the tensions in the transverse webs resulting from the bellows motion of the pleated structure. In addition, the cable reinforcement prevents lateral buckling of the load carrying areas containing the springs at narrow roadbed gaps. This effect is achieved fully in particular when the load carrying areas are designed as more or less solid webs alternating in oblique extension relative to the lengthwise direction of the strip. Here, the oppositely directed deforming tendency of the load carrying areas is inhibited by the cables running in the longitudinal direction of the strip.

As will be seen from the foregoing, an expansion joint assembly of the kind described at the outset is provided having at the same time great ductility and elasticity in the tension as well as compression direction and high load carrying capacity while retaining a stable position which prevents any buckling upwardly in all states of deformation or expansion. Great strength is obtained by the use of spring means as reinforcements and preferably of helically wound coils, which are spaced in juxtaposition and preferably made of spring steel or a similar hard-elastic material, since their longitudinal axes are transverse to the longitudinal direction of the joint, and concomitantly parallel to the direction of road travel and their opposite ends are joined to the connecting brackets.

The helical springs act in the sense of reinforcing inserts which increase the load carrying capacity while at the same time not imparing the resiliency of the elastomeric strip. As a result narrow strip widths will suffice in use. Suitable selection of the spacing of the springs, as well as in the configuration of their turns makes it possible to form assemblies in which the elasticity and load carrying conform to the respective conditions of roadbed use. Of importance for the load carrying capacity of the strip is the tension-proof (i.e. secure) anchoring of the ends of the springs to the adjacent connecting brackets of the strip. As a result the springs react directly and conjointly with the expansion and contraction of the roadbed gap.

When the springs are disposed eccentrically relative to the central horizontal plane of the strip, namely closer to its lower bearing surface, which is opposite (away from) the traveled surface, the resultant lines of force on the strip is low, which causes the elastomeric strip to be pushed down against the subbase when stressed in compression or pulled under tension. Thus, buckling is effectively precluded.

Various modifications, embodiments, changes, and alternatives have been disclosed and others will be readily apparent to those skilled in this art. Accordingly, it is intended that the present disclosure be taken as illustrative only of the invention and not limiting thereof.

What is claimed:

1. A vertical load bearing expansion joint assembly for sealing a gap in vehicular roadbeds and the like, comprising an elongated strip of elastomeric material having anchoring means along its side edges for fixedly connecting the same to the opposed sections of the roadbed across the gap in said joint, a plurality of helical coils embedded within and bonded to the elastomeric material of the strip to be conjointly movable therewith, said helical coils extending transverse to the longitudinal axis of said strip in parallel spaced relationship along the length of said strip, each of said helical coils being secured at its ends to the respective anchoring means so as to conjointly expand or contract with said strip corresponding to the movement of the roadbed sections and provide reinforcement for vertical load on said strip.

2. The assembly according to claim 1, wherein the helical coils are disposed below the central horizontal plane of the strip.

3. The assembly according to claim 1 including at least one additional layer of spring means arranged above the helical coils.

4. The assembly according to claim 3, wherein the spring means in said upper layer are secured at one end to an adjacent anchoring means and extend freely to the interior of said strip.

5. The assembly according to claim 5, wherein the spring means of the upper layer are staggered relative to those of the lower layer.

6. The assembly according to claim 1 or 4, wherein the said helical coils comprise a pair of helical coils arranged one-within-the-other.

7. The assembly according to claim 7, wherein the cross-sectional dimensions of the respective coils arranged within each other are different.

8. The assembly according to claim 1 or 3, wherein the turns of said helical coils differ periodically in size.

9. The assembly according to claim 8, wherein the turns of one size alternate with turns of another size.

10. The assembly according to claim 1 or 3, wherein said helical coils have different pitch lead in periodically repeating sections.

11. The assembly according to claim 10, wherein sections of one pitch alternate with sections of a different pitch.

12. The assembly according to claim 1 or 3, wherein said helical coils have turns of noncircular cross-sections.

13. The assembly according to claim 1, wherein said strip is formed with a hollow bore through said helical coils.

14. The assembly according to claim 13, wherein the hollow bore has a surface of an internal thread and wherein the turns of the helical coils border the surface of the bore in the area of the threaded webs.

15. The assembly according to claim 14, including a slide rod extending through said hollow bore.

16. The assembly according to claim 1, wherein said strip is formed with a plurality of cavities open to the bottom surface thereof.

17. The assembly according to claim 16, wherein said cavities extend across the entire transverse width of the strip.

18. The assembly according to claim 1, wherein said strip is formed in the longitudinal direction, having areas of great load carrying capacity and areas of high deformability alternating with each other.

19. The assembly according to claim 18, wherein said spring means are embedded within the areas of great load carrying capacity.

20. The assembly according to claim 18, wherein the deformable areas have pleat structures embedded therein the fold direction of which being transverse to the longitudinal axis of the strip.

21. The assembly according to claim 20, including a cable reinforcement extending over the entire length of the strip cast integrally into the upper and the lower webs of the pleat structures.

22. The assembly according to claim 18, wherein the load carrying areas comprise webs extending alternately obliquely relative to the lengthwise direction of the strip.

23. The assembly according to claim 1 wherein the strip is formed as a pleat structure extending over its entire length, the fold lines of which are parallel to the lengthwise direction of the strip.

24. The assembly according to claim 23, wherein the cross-sectional dimension of the spring means, perpendicular to the strip plane, conforms to the pleat height.

25. The assembly according to claim 24, wherein the upper and lower webs of the pleat structure are connected by a cable reinforcement cast or vulcanized therein.

* * * * *